US006019019A

United States Patent [19]

Hobbs

[11] Patent Number: 6,019,019

[45] Date of Patent: Feb. 1, 2000

[54] CLEARANCE EXTENSION FOR WRENCHES

[75] Inventor: Rick Anthony Hobbs, Sterling Heights, Mich.

[73] Assignee: Specialty Auto Parts USA, Inc., Roseville, Mich.

[21] Appl. No.: 09/058,099

[22] Filed: Apr. 9, 1998

[51] Int. Cl.[7] ..... B25B 23/16

[52] U.S. Cl. ..... 81/177.2; 81/177.85

[58] Field of Search ..... 81/177.2, 177.85

[56] References Cited

U.S. PATENT DOCUMENTS

| | | | |
|---|---|---|---|
| D. 245,395 | 8/1977 | Cognevich | 81/177.85 |
| D. 260,355 | 8/1981 | Buzzell . | |
| 1,578,065 | 10/1926 | Bemus et al. . | |
| 2,502,587 | 4/1950 | Phipps . | |
| 2,651,230 | 9/1953 | Waterval . | |
| 3,376,768 | 4/1968 | Fortunato | 81/177.2 |
| 3,815,451 | 6/1974 | Penner . | |
| 3,875,829 | 4/1975 | Evans et al. . | |
| 3,877,328 | 4/1975 | Sullivan . | |
| 4,096,896 | 6/1978 | Engel . | |
| 4,699,029 | 10/1987 | Kelly et al. | 81/177.85 |
| 5,168,782 | 12/1992 | Cromwell | 81/177.2 |
| 5,216,940 | 6/1993 | Hedden | 81/177.2 |
| 5,438,894 | 8/1995 | Pearce . | |
| 5,485,769 | 1/1996 | Olson et al. | 81/177.85 |
| 5,568,757 | 10/1996 | Lewis . | |
| 5,626,062 | 5/1997 | Colvin . | |
| 5,676,028 | 10/1997 | Jordan . | |
| 5,752,418 | 5/1998 | Robins | 81/177.2 |

*Primary Examiner*—David A. Scherbel
*Assistant Examiner*—Joni B. Danganan
*Attorney, Agent, or Firm*—Harness, Dickey & Pierce, P.L.C.

[57] ABSTRACT

An attachment for transmitting torque from a wrench to a socket is provided which has a first end adaptable to be connected to a socket and a second end having an outer surface which can be driven by a wrench. The geometry of the second end is such to allow a wrench having a small size to be engageable thereto.

9 Claims, 1 Drawing Sheet

FIG-1
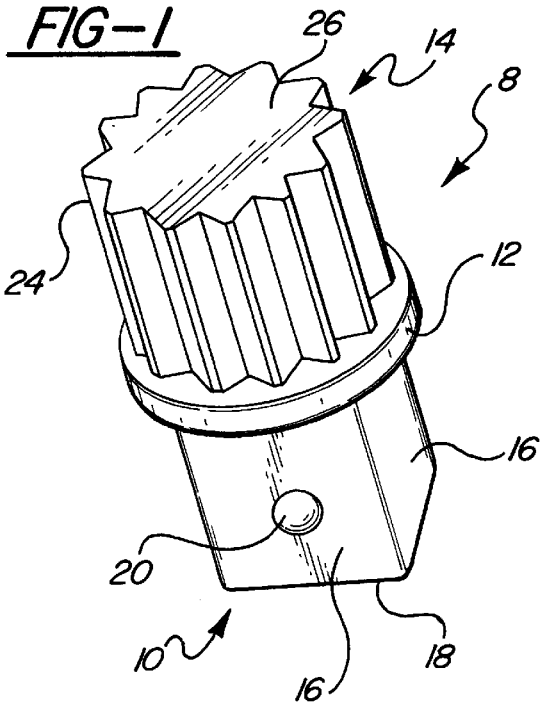
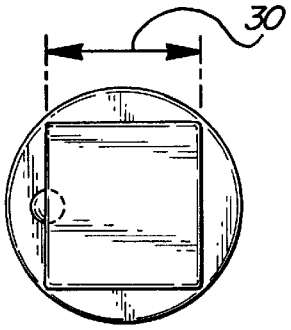
FIG-2
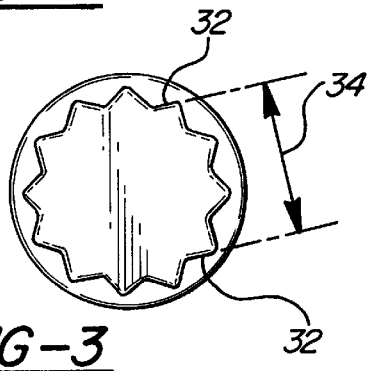
FIG-3
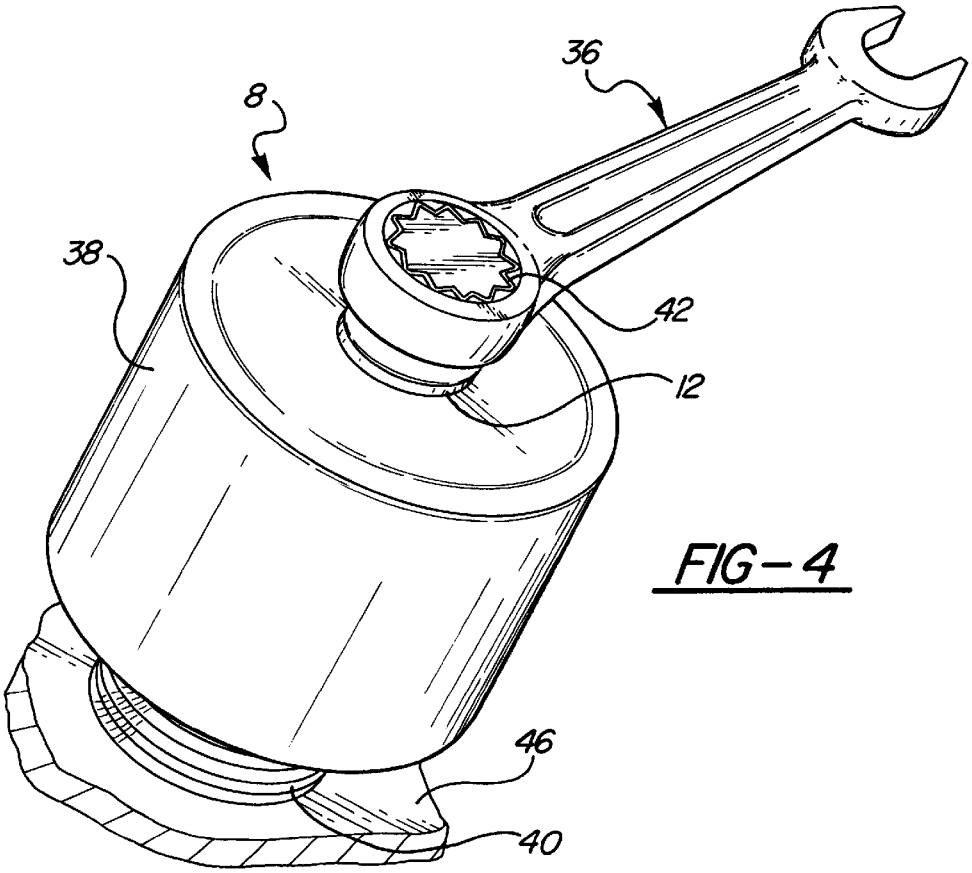
FIG-4

CLEARANCE EXTENSION FOR WRENCHES

BACKGROUND OF THE INVENTION

I. Technical Field

The present invention relates generally to a clearance extension for a wrench and, more particularly, to a clearance extension for a wrench which allows a standard socket of any specific size to be tightened with a standard wrench of substantially and relatively smaller size.

II. Discussion

Various mechanical arts, such as auto repair and manufacturing, require the tightening of various bolt and screw members. Traditionally, tightening of these members is accomplished by the use of a socket and socket driver. The socket has a first portion which slides over the head of a bolt or screw member and a second portion which has a square aperture for engagement with the socket driver. The socket driver has a ratchet mechanism which allows torque to be applied in the desired rotational direction only. Because of this ratchet mechanism, the arm of the socket driver can be swung back to an initial turning position without applying torque to the socket and thus the bolt or screw member. Thus, the rachet mechanism allows a user to move the rachet to an initial turning position without removal of the socket driver from the socket.

However, the use of the socket driver presents some problems. First, because the socket driver contains a ratchet mechanism, the overall relative size of the socket driver is large and bulky. This large and bulky size presents clearance difficulties when using the socket driver in tight and hard-to-reach places. Second, even if a socket is used to initially start a threaded bolt into a threaded hole that is located in a hard-to-reach location, applying initial torque with fingers can be difficult. Third, applying initial torque with a socket driver can be impossible due to insufficient clearance for the driver to function.

Devices have been developed which allow a standard wrench to drive a standard socket located in a hard-to-reach position. These devices include wrench extensions such as those disclosed in U.S. Pat. No. 5,438,894 (Pearce) and U.S. Pat. No. 5,568,757 (Lewis). The devices of these references do not require socket drivers and generally disclose extensions having a first end adaptable to receive a standard wrench and a second end insertable into a standard socket. Thereby, a standard wrench is used to apply torque through a socket and ultimately to the bolt or screw to be tightened.

These extension devices do not, however, permit engagement by a standard wrench of substantially and relatively smaller size. Instead, the extension device typically contains a square opening in a round end face portion of the extension, such square opening is used to engage the socket driver of a ratchet wrench. Of necessity, the diameter of the round end face portion, which is used to engage the standard wrench, must be relatively larger than the square opening. Thereby, a larger sized wrench is required than what would be required without the square opening. The present invention was developed in light of these drawbacks.

SUMMARY OF THE INVENTION

The present invention overcomes these access problems by providing a clearance extension for wrenches which transmits torque from a wrench to a socket. The present invention has a first and second portion. The first portion has a box configuration which is adaptable for insertion into a driving portion of a standard socket. The second portion, being in axial alignment with the first portion, has an outer perimeter surface adaptable for engagement by the driving portion of a standard wrench. In another aspect of the present invention, the end face of the second portion is substantially flat and solid. Because of this flat and solid configuration, the second portion can support a wrench of a smaller size than would otherwise be possible. The unique utility of the present invention in solving clearance problems results from the fact that the first portion of the clearance extension can be substantially and relatively larger in size than the second portion. Typically, the first portion is adaptable to engage a standard socket having a 0.5 inch, 0.375 inch or a 0.25 inch driving portion, while the second portion is adaptable for engagement with a standard wrench having a relatively smaller size, typically 0.25 inches. Thus, the driving portion of the present invention is engageable with a socket having a nominal size larger than or equal to the nominal size of the wrench.

Additional advantages and features of the present invention will become apparent from the subsequent description and the appended claims taken in conjunction with the accompanying drawings.

BRIEF DESCRIPTION OF THE DRAWINGS

In the drawings which illustrate the best mode presently contemplated for carrying out the present invention:

FIG. 1 is a perspective view of a clearance extension for wrenches according to the present invention;

FIG. 2 is a plan view of an end face of a clearance extension for wrenches according to the present invention;

FIG. 3 is a plan view of an end face of a clearance extension for wrenches according to the present invention; and FIG. 4 is a perspective view of a clearance extension for wrenches incorporating a standard wrench and a standard socket according to the present invention.

DETAILED DESCRIPTION OF THE DRAWINGS

With reference to FIG. 1, the components of the present invention are now described. FIG. 1 illustrates a clearance extension 8 for wrenches having a first portion 10, spacer 12 and second portion 14. The first portion 10 typically has four sides 16 and end face 18. On any one of the particular sides 16, detent 20 (to be discussed) is positioned. The nominal size of the first portion 10 is determined by measuring dimension 30 (see FIG. 2) across end face 18. This dimension is a standard used in the tool industry for describing sizes of socket drivers.

Second portion 14 generally has outer perimeter surface 24 and end face 26. Outer surface 24 has a perimeter configuration with typically 12 points for engagement in a standard 12-point wrench as is well known in the art. However, outer surface 24 may be hexagonally shaped or have any other shape effective for engagement with the internal diameter of a torque-supplying tool such as a wrench. Outer surface 24 generally has a plurality of parallel flats 32 such as the pair as shown (see FIG. 3). The nominal size of outer surface 24 can be determined by measuring dimension 34 across parallel flats 32. This size is used to describe the size of a wrench suitable for engagement with outer surface 24 and is a well known tool industry standard for wrench sizes.

In FIG. 4, the application of the present invention is shown. The clearance extension 8 for wrenches is shown in combination with wrench 36, socket 38 and bolt 40. Wrench 36 has a 12-pt aperture 42 which is adaptable to slide over outer surface 24 of second portion 14 in a rotationally engageable fashion. Socket 38 has a square shaped aperture (not shown but well known in the art) which is adaptable to receive first portion 10. Socket 38 engages bolt 40 for supplying torque thereto as is well known in the art. Spacer 12 maintains wrench 36 and socket 38 in a spaced relationship from each other. Preferably, spacer 12 has a thickness which allows a minimum distance between wrench 36 and socket 38. It is noted that spacer 12 is not necessary and can be eliminated. This limited space, combined with the fact that the nominal size of socket 38 can be substantially and relatively larger than the normal size of outer surface 24, ensures that the overall bulkiness of the combination of wrench 36, clearance extension 8 for wrenches, and socket 38 is as little as possible. As a result, the ability of using the combination of wrench 36, clearance extension 8 for wrenches, and socket 38 in tight and hard-to-reach spaces is enhanced.

With reference to FIG. 4, the operation of the present invention will now be described. In operation, clearance extension for wrench 8 is first inserted into socket 38. Aperture 42 of wrench 36 is slid over outer surface 24. Socket 38 is then engaged to a head of bolt 40. Turning wrench 36 applies rotational torque to flats 32 (see FIG. 3) which is transmitted through clearance extension 8 for wrenches and ultimately to socket 38. Socket 38, in turn, transmits the torque to bolt 40 which allows bolt 40 to be screwed into or out of surface 46.

Additional advantages and features of the present invention will become apparent from the subsequent description and the appended claims taken in conjunction with the accompanying drawings.

What is claimed is:

1. An attachment for transmitting torque from a standard wrench to a standard socket, said attachment comprising:

a first portion, said first portion having four sides and an end face, said four sides and said end face positioned to form a box configuration, said first portion adaptable for engageable insertion into a driven portion of a standard socket; and a second portion in axial alignment with said first portion along an axis of rotation, said second portion having an outer surface and an end face, said outer surface adaptable for engageable insertion into a driving portion of a standard wrench, wherein said first portion of said attachment is in size, in all dimensions perpendicular to the axis of rotation, greater than or equal to said second portion.

2. The attachment as claimed in claim 1, wherein one of said sides of said first portion has a protrusion for securing said first portion to said socket.

3. The attachment as claimed in claim 1, wherein said outer surface of said second portion is adaptable for engageable insertion into a 12-point wrench.

4. The attachment as claimed in claim 1, wherein said first portion is adaptable for engageable insertion into a socket having a driven portion of a size which is a member of the set consisting of 0.5 inch, 0.375 inch and 0.25 inch.

5. The attachment as claimed in claim 1, wherein said outer surface of said second portion is adaptable for engageable insertion into a hex head wrench.

6. An apparatus for tightening or loosening a threaded member, said apparatus comprising:

a wrench having an aperture at one end, said aperture having a plurality of flat surfaces around a periphery of said aperture;

an attachment for transmitting torque from said wrench to a socket, said attachment having a first end and a second end in axial alignment along an axis of rotation, said second end having a plurality of flat surfaces and an end face, said flat surfaces circumferentially located around said axis of rotation, said plurality of flat surfaces being oriented such that said second end is insertable into and rotationally engageable by said aperture of said wrench, said first end being box shaped; and a socket having a first end and a second end, said second end of said socket having a box shaped aperture for engageable insertion by said first end of said attachment, said first end of said socket being selectively engageable with a driven portion of said threaded member, wherein said first end of said attachment is in size, in all dimensions perpendicular to said axis of rotation, greater than or equal to said second portion.

7. The apparatus as claimed in claim 6, wherein said end face of said second end of said attachment is substantially flat.

8. The apparatus as claimed in claim 6, wherein said driven portion of said threaded member is a screw head.

9. An attachment for transmitting torque from a standard wrench to a standard socket, said attachment comprising:

a first portion, said first portion having four sides and an end face, said four sides and said end face positioned to form a box configuration, said first portion adaptable for engageable insertion into a driven portion of a standard socket; and a second portion in axial alignment with said first portion along an axis of rotation, said second portion having an outer surface and an end face, said outer surface adaptable for engageable insertion into a driving portion of a standard wrench, said end face of said second portion having a size equal to or smaller than said driven portion of said socket.

* * * * *